US009524679B2

(12) United States Patent
Aitken et al.

(10) Patent No.: US 9,524,679 B2
(45) Date of Patent: Dec. 20, 2016

(54) BACKLIGHT SYSTEM FOR A DISPLAY

(75) Inventors: Andrew P. Aitken, Sunnyvale, CA (US); Ulrich T. Barnhoefer, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 1749 days.

(21) Appl. No.: 12/887,243

(22) Filed: Sep. 21, 2010

(65) Prior Publication Data

US 2012/0068978 A1 Mar. 22, 2012

(51) Int. Cl.
*G09G 5/10* (2006.01)
*G09G 3/34* (2006.01)

(52) U.S. Cl.
CPC .... *G09G 3/3406* (2013.01); *G09G 2320/0247* (2013.01); *G09G 2320/064* (2013.01); *G09G 2320/0606* (2013.01); *G09G 2320/0633* (2013.01); *G09G 2330/021* (2013.01); *G09G 2360/144* (2013.01)

(58) Field of Classification Search
USPC ..... 345/207, 691
See application file for complete search history.

(56) References Cited

U.S. PATENT DOCUMENTS

| | | | | |
|---|---|---|---|---|
| 6,888,529 | B2 | 5/2005 | Bruning et al. | |
| 7,183,723 | B2 | 2/2007 | Yu et al. | |
| 7,615,974 | B1 | 11/2009 | Xu | |
| 7,667,683 | B2 | 2/2010 | Chen et al. | |
| 2002/0005861 | A1* | 1/2002 | Lewis | 345/691 |
| 2005/0083274 | A1 | 4/2005 | Beddes et al. | |
| 2006/0127081 | A1* | 6/2006 | Lee et al. | 396/282 |
| 2008/0297879 | A1* | 12/2008 | Tonar et al. | 359/265 |
| 2009/0179848 | A1 | 7/2009 | Schmitdt et al. | |

FOREIGN PATENT DOCUMENTS

| | | | |
|---|---|---|---|
| CN | 1643444 B | | 12/2010 |
| JP | 2010 060746 | * | 3/2010 |
| KR | 10-2009-0077660 A | | 7/2009 |
| TW | 201131261 | | 9/2011 |

OTHER PUBLICATIONS

Korean Notice of Preliminary Rejection for Application No. KR10-2011-95405 dated Dec. 18, 2012; 4 pages.
Taiwan Office Action for Taiwanese Application No. 100134020 dated Nov. 21, 2013; 25 pgs.
Chinese Office Action for Chinese Application No. 201110433795.1 dated Nov. 21, 2013; 14 pgs.

* cited by examiner

*Primary Examiner* — Amare Mengistu
*Assistant Examiner* — Shawna Stepp Jones
(74) *Attorney, Agent, or Firm* — Fletcher Yoder PC

(57) ABSTRACT

A method and system for modifying a pulse width modulation signal for controlling the backlit illumination intensity of a liquid crystal display. The modified pulse width modulated signal may be selected to operate with at least one pulse having a first duty cycle with the remaining pulses in the pulse width modulation signal having a second duty cycle across a selected number of pulses making up a given time period (i.e., frame). By utilizing more than one duty cycle for the pulses of the pulse width modulated signal to drive light sources in a display during a given frame, the overall number of backlit illumination intensities for the liquid crystal display may be increased. By distributing the differing pulse duty cycles within a group of pulses of within a frame, visible artifacts may be reduced.

15 Claims, 6 Drawing Sheets

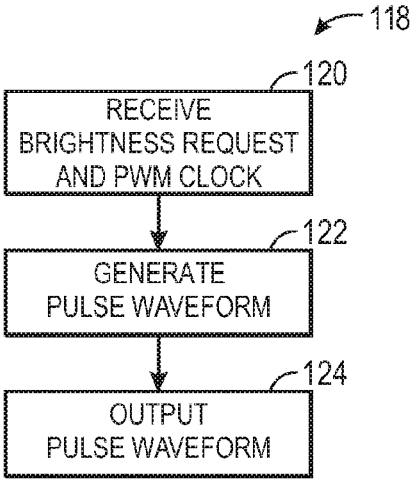
FIG. 8
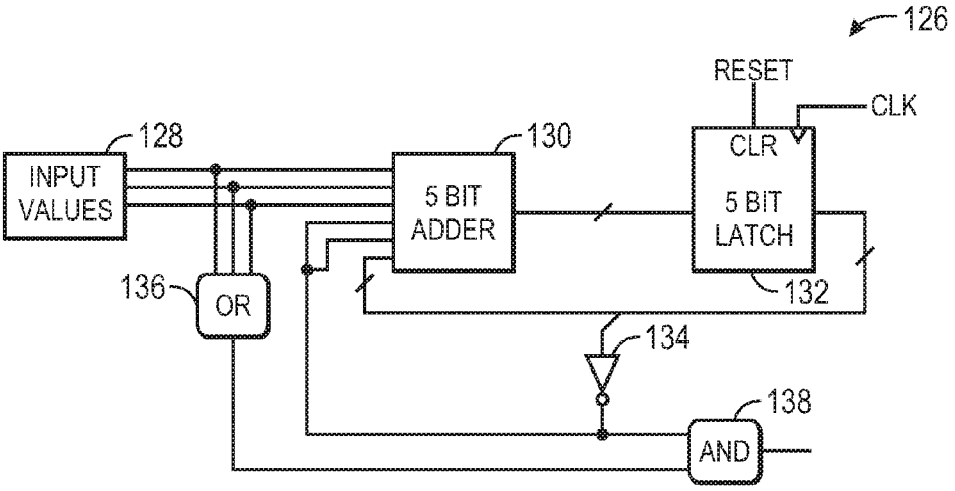
FIG. 9
| | |
|---|---|
| 0 | 00000000 |
| 1 | 10000000 |
| 2 | 10001000 |
| 3 | 10010010 |
| 4 | 10101010 |
| 5 | 10101101 |
| 6 | 10111011 |
| 7 | 10111111 |
140
FIG. 10

BACKLIGHT SYSTEM FOR A DISPLAY

BACKGROUND

The present disclosure relates generally to controlling the backlight illumination source of a liquid crystal display.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic devices increasingly include display screens as part of the user interface of the device. As may be appreciated, display screens may be employed in a wide array of devices, including desktop computer systems, notebook computers, and handheld computing devices, as well as various consumer products, such as cellular phones and portable media players. Liquid crystal display (LCD) panels have become increasingly popular for use in display screens. This popularity can be attributed to their light weight and thin profile, as well as the relatively low power it takes to operate the LCD pixels.

The LCD typically makes use of backlight illumination because the LCD does not emit light on its own. Backlight illumination typically involves supplying the LCD with light from a cathode fluorescent lamp or from light emitting diodes (LEDs). To reduce power consumption, one or more groupings of LEDs may be utilized such that the one or more groupings are periodically activated and deactivated. However, to date, this configuration has led to limited brightness adjustment ranges. Therefore, there exists a need for controlling LEDs of an LCD through techniques that allow for broad dimming ranges for the LCD.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to a backlight unit for a display device, such as an LCD display. In one embodiment, an edge-lit backlight unit may include LEDs, and control of the activation and deactivation of the LEDs may be accomplished through the application of a pulse width modulator (a pulse width modulation device or clock) that supplies a pulse for activating and deactivating the LEDs to adjust the brightness of the display. Furthermore, a pulse width modulated (PWM) signal generated by the pulse width modulator may be adjusted based on a desired brightness. For example, a modified pulse width modulation signal may be selected to include a first duty cycle for a number of pulses over a given period of time (i.e., a frame) and a second duty cycle for any remaining number of pulses over the given period of time. By utilizing more than one duty cycle for the pulses of the pulse width modulated signal to drive light sources in a display during a given frame, the overall number of backlit illumination intensities for the liquid crystal display may be increased.

BRIEF DESCRIPTION OF THE DRAWINGS

Various aspects of this disclosure may be better understood upon reading the following detailed description and upon reference to the drawings in which:

FIG. 8 is flow diagram illustrating the operation of the components of FIG. 4, in accordance with one embodiment of the present invention.

FIG. 9 is a simplified block diagram illustrating components of a delta-sigma bitstream generator of the electronic device of FIG. 1, in accordance with one embodiment of the present invention;

FIG. 10 is chart corresponding to input values of the delta-sigma bitstream generator of FIG. 9, in accordance with one embodiment of the present invention.

DETAILED DESCRIPTION OF SPECIFIC EMBODIMENTS

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The application is generally directed to a method and system for controlling backlighting of a display. A pulse width modulated (PWM) signal may be transmitted to a display. Through the control of the duty cycle of the PWM signal, the brightness of the display may be adjusted. Furthermore, the PWM signal may be adjusted to generate a pulse waveform that differs from the initially generated PWM signal based on a desired brightness for the display. Adjustment of the PWM signal may include selecting one or more pulses of the PWM signal to remain in an on state that exceeds the on state of other pulses of the PWM signal. By utilizing differing on times for pulses in the PWM signal, the overall number of backlit illumination intensities for the liquid crystal display may be increased. Moreover, by selectively locating the extended on pulses in the PWM signal, visual artifacts on the display may be reduced while maintaining a reduced overall power consumption of the display. Thus, a temporal PWM sequence that averages (over a pre-determined interval) to a higher resolution than the PWM can provide by itself without such a temporal sequence may be created.

Figure 1:
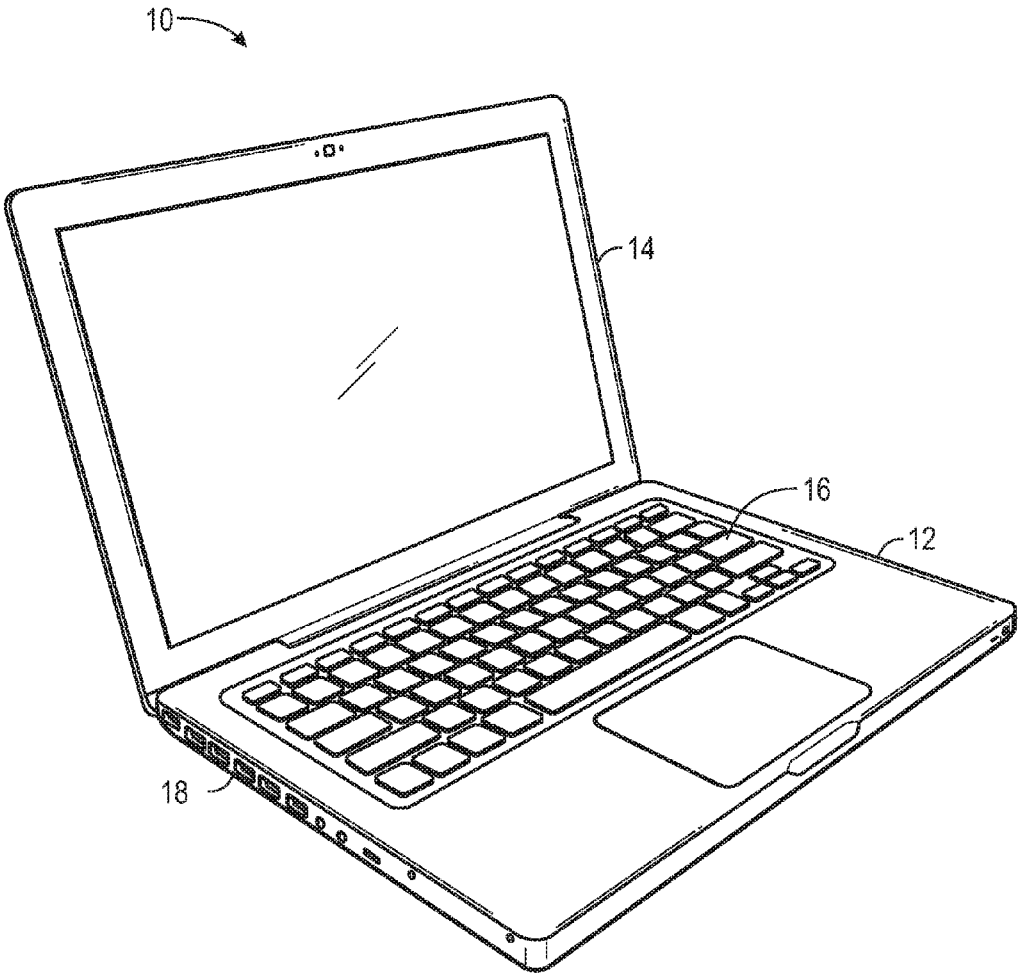
FIG. 1 is a perspective view illustrating an electronic device, in accordance with one embodiment of the present invention.

An electronic device 10 is illustrated in FIG. 1 in accordance with one embodiment of the present invention. In some embodiments, including the presently illustrated embodiment, the device 10 may be a portable electronic device, such as a laptop computer. Other electronic devices may also include a viewable media player, a cellular phone, a personal data organizer, or the like. Indeed, in such embodiments, a portable electronic device may include a combination of the functionalities of such devices. In addition, the electronic device 10 may allow a user to connect to and communicate through the Internet or through other networks, such as local or wide area networks. For example, the portable electronic device 10 may allow a user to access the Internet and to communicate using e-mail, text messaging, or other forms of electronic communication. By way of example, the electronic device 10 may be a model of a MacBook®, MacBook® Pro, MacBook Air®, iMac®, Mac® mini, or Mac Pro® available from Apple Inc. of Cupertino, Calif. In other embodiments, the electronic device may include other models and/or types of electronic devices employing LED backlights, available from any manufacturer.

In certain embodiments, the electronic device 10 may be powered by one or more rechargeable and/or replaceable batteries. Such embodiments may be highly portable, allowing a user to carry the electronic device 10 while traveling, working, and so forth. While certain embodiments of the present invention are described with respect to a portable electronic device, it should be noted that the presently disclosed techniques may be applicable to a wide array of other electronic devices and systems that are configured to render graphical data, such as a desktop computer.

In the presently illustrated embodiment, the electronic device 10 includes an enclosure or housing 12, a display 14, input structures 16, and input/output (I/O) ports or connectors 18. The enclosure 12 may be formed from plastic, metal, composite materials, or other suitable materials, or any combination thereof. The enclosure 12 may protect the interior components of the electronic device 10, such as processors, circuitry, and controllers, among others, from physical damage, and may also shield the interior components from electromagnetic interference (EMI).

The display 14 may be a liquid crystal display (LCD). The LCD may be a light emitting diode (LED) based display or some other suitable display. As noted above, the electronic device 10 may also include input structures 16. In one embodiment, one or more of the input structures 16 are configured to control the device 10, such as by controlling a mode of operation, an output level, an output type, etc. For instance, the input structures 16 may include a button to turn the device 10 on or off. Further the input structures 16 may allow a user increase or decrease the brightness of the display 14. Embodiments of the portable electronic device 10 may include any number of input structures 16, including buttons, switches, a control pad, a keypad, or any other suitable input structures that may be used to interact with electronic device 10. These input structures 16 may operate to control functions of the electronic device 10 and/or any interfaces or devices connected to or used by the electronic device 10. For example, the input structures 16 may allow a user to navigate a displayed user interface, such as a graphical user interface (GUI), and/or other applications running on the electronic device 10.

The device 10 may also include various I/O ports 18 to allow connection of additional devices. For example, the device 10 may include any number of input and/or output ports 18, such as headphone and headset jacks, universal serial bus (USB) ports, IEEE-1394 ports, Ethernet and modem ports, and AC and/or DC power connectors. Further, the electronic device 10 may use the I/O ports 18 to connect to and send or receive data with any other device, such as a modem, networked computers, printers, or the like. For example, in one embodiment, the electronic device 10 may connect to an iPod via a USB connection to send and receive data files, such as media files.

Figure 2:
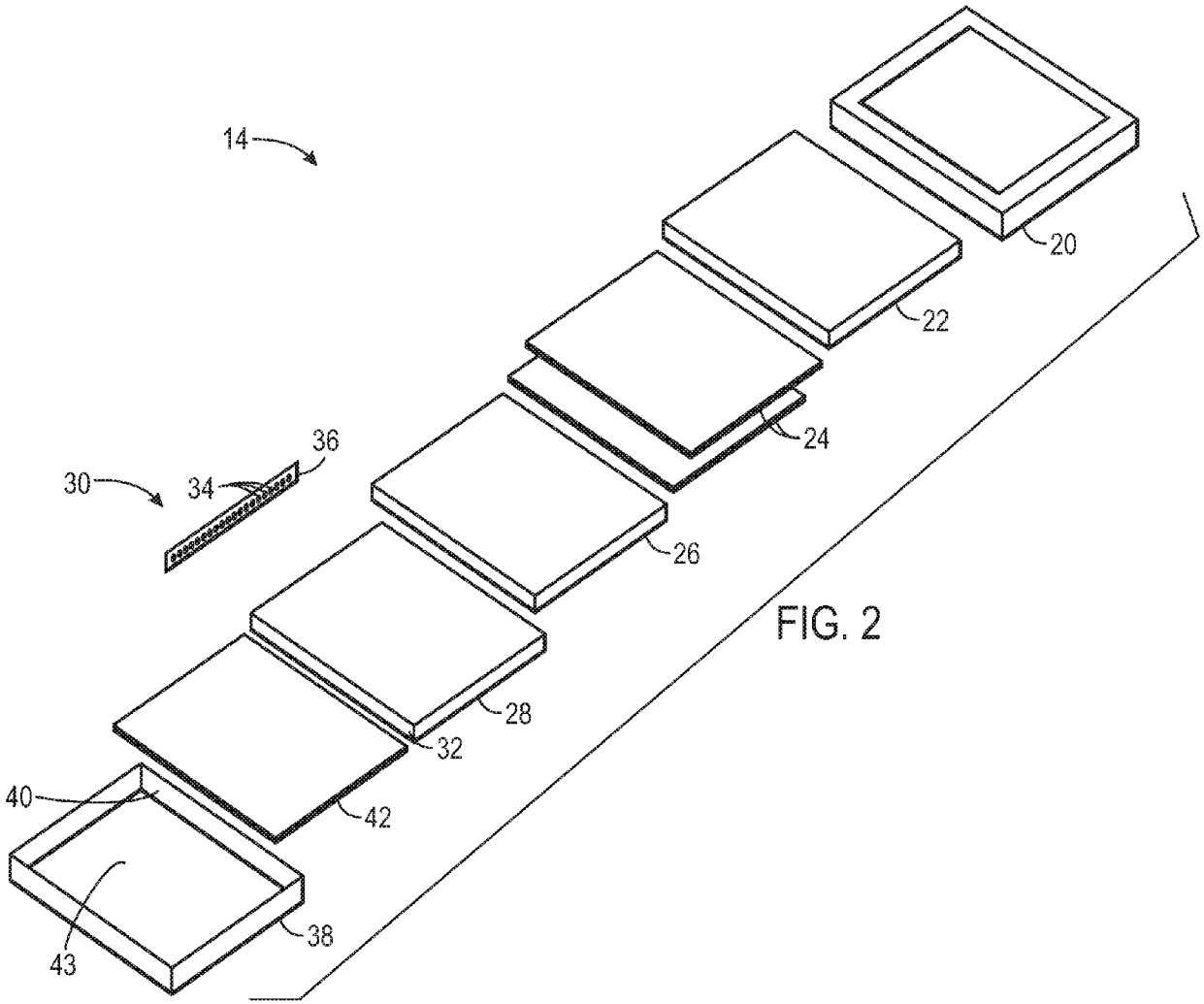
FIG. 2 is an exploded perspective view of an LCD, in accordance with one embodiment of the present invention.

Additional details of the display 14 may be better understood through reference to FIG. 2, which is an exploded perspective view of one example of the LCD type display 14. The display 14 includes a top cover 20. The top cover 20 may be formed from plastic, metal, composite materials, or other suitable materials, or any combination thereof. In one embodiment, the top cover 20 is a bezel. The top cover 20 may also be formed in such a way as combine with a bottom cover 38 to provide a support structure for the remaining elements illustrated in FIG. 2. A liquid crystal display (LCD) panel 22 is also illustrated. The LCD panel 22 may be disposed below the top cover 20. The LCD panel 22 may be used to display an image through the use of a liquid crystal substance typically disposed between two substrates. For example, a voltage may be applied to electrodes, residing either on or in the substrates, creating an electric field across the liquid crystals. The liquid crystals change in alignment in response to the electric field, thus modifying the amount of light which may be transmitted through the liquid crystal substance and viewed at a specified pixel. In such a manner, and through the use of various color filters to create colored sub-pixels, color images may be represented across individual pixels of the display 14 in a pixilated manner.

The LCD panel 22 may include a group of individually addressable pixels. In one embodiment, LCD panel 22 may include a million pixels, divided into pixel lines each including one thousand pixels. The LCD panel 22 may also include a passive or an active display matrix or grid used to control the electric field associated with each individual pixel. In one embodiment, the LCD panel 22 may include an active matrix utilizing thin film transistors disposed along pixel intersections of a grid. Through gating actions of the thin film transistors, luminance of the pixels of the LCD panel 22 may be controlled. The LCD panel 22 may further include various additional components, such as polarizing films and anti-glare films.

The display 14 also may include optical sheets 24. The optical sheets 24 may be disposed below the LCD panel 22 and may condense the light passing to the LCD panel 22. In one embodiment, the optical sheets 24 may be prism sheets which may act to angularly shape light passing through to the LCD panel 22. The optical sheets 24 may include either one or more sheets. The display 14 may further include a diffuser plate or sheet 26. The diffuser plate 26 may be disposed below the LCD panel 22 and may also be disposed either above or below the optical sheets 24. The diffuser plate 26 may diffuse the light being passed to the LCD panel 22. The diffuser plate 26 may also reduce glaring and non-uniform illumination on the LCD panel 22. A guide plate 28 may also assist in reducing non-uniform illumination on the LCD panel 22. In one embodiment, the guide plate 28 is part of an edge type backlight assembly. In an edge type backlight assembly, a light source 30 may be disposed along one side of the guide plate 28, such as the bottom edge 32 of the guide plate 28. The guide plate 28 may the act to channel the light emanating from the light source 30 upwards towards the LCD panel 22.

The light source 30 may include light emitting diodes (LEDs) 34. The LEDs 34 may be a combination of red, blue, and green LEDs, or the LEDs 34 may be white LEDs. In one embodiment, the LEDs 34 may be arranged on a printed circuit board (PCB) 36 adjacent to an edge of the guide plate 28, such as bottom edge 32, as part of an edge type backlight assembly. In another embodiment, the LEDs 34 may be arranged on one or more PCBs 36 along the inside surface of bottom cover 38. For example, the one or more PCBs 36 may be aligned along an inner side 40 of the bottom cover 38. The LEDs 34 may be arranged in one or more strings, whereby a number of the LEDs 34 are coupled in series with one another in each string. For example, the LEDs 34 may be grouped into six strings, whereby each string includes three LEDs 34 connected in series. However, it should be noted, that as few as one or two LED 34 may be connected on each string or more than three LEDs 34, such as six LEDs, may be connected on each string. Furthermore, the strings may be positioned in an end to end configuration, a side by side configuration, and/or in any other suitable configuration.

The display 14 also may include a reflective plate or sheet 42. The reflective plate 42 is generally disposed below the guide plate 28. The reflective plate 42 acts to reflect light that has passed downwards through the guide plate 28 back towards the LCD panel 22. Additionally, the display includes a bottom cover 38, as previously discussed. The bottom cover 38 may be formed in such a way as to combine with the top cover 20 to provide a support structure for the remaining elements illustrated in FIG. 2. The bottom cover 38 may also be used in a direct-light type backlight assembly, whereby one or more light sources 30 are located on a bottom edge 43 of the bottom cover 38. In this configuration, instead of using a light source 30 positioned adjacent the diffuser plate 26 and/or guide plate 28, the reflective plate 42 may be omitted and one or more light sources (not shown) on the bottom edge 43 of the bottom cover 38 may emit light directly towards the LCD panel 22.

Figure 3:
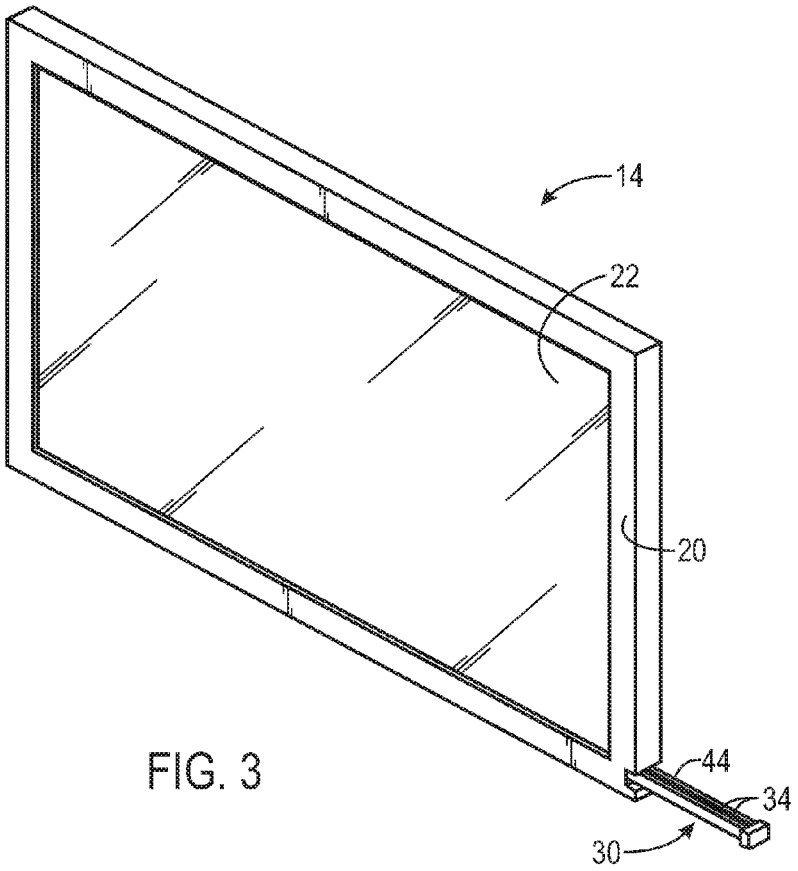
FIG. 3 is a perspective view illustrating an LCD that may be used in the electronic device of FIG. 1, in accordance with one embodiment of the present invention.

FIG. 3 depicts an embodiment of display 14 employing an edge-lit backlight. Display 14 includes the LCD panel 22 held in place, as illustrated, by the top cover 20. As described above, the display 14 may utilize a backlight assembly such that a light source 30 may include LEDs 34 mounted on, for example, a Metal Core Printed Circuit Board (MCPCB), or other suitable type of support situated upon an array tray 44 in the display 14. This array tray 44 may be secured to the top cover 20 such that the light source 30 is positioned in the display 14 for light generation, which may be utilized to generate images on the LCD panel 22.

The light source 30 may also include circuitry required to translate an input voltage into an LED voltage usable to power the LEDs 34 of the light source 30. Since the light source 30 may be used in a portable device, it is desirable to use as little power as possible to increase the battery life of the electronic device 10. To conserve power, the light source 30, i.e., the LEDs 34 thereon, may be toggled on and off. In this manner, power in the system may be conserved because the light source 30 need not be powered continuously. Furthermore, this toggling will appear to create constant images to a viewer if the frequency of toggling is kept above at least the flicker-fusion frequency of the human eye, typically 60 Hz or above.

In addition to conserving power, by adjusting the duty cycle (the ratio of the time that the light source 30 is on relative to the amount of time that the light source 30 is on and off) of the toggled light source 30, the overall brightness of the LCD panel 22 may be controlled. For example, a duty cycle of 50% would result in an image being displayed at roughly half the brightness of constant backlight illumination. In another example, a duty cycle of 20% results in an image being displayed at roughly 20% of the brightness that constant backlight illumination would provide. Thus, by adjusting the duty cycle of a toggled signal, the brightness of a displayed image may be adjusted with the added benefit of reducing the power consumed in the electronic device 10.

Figure 4:
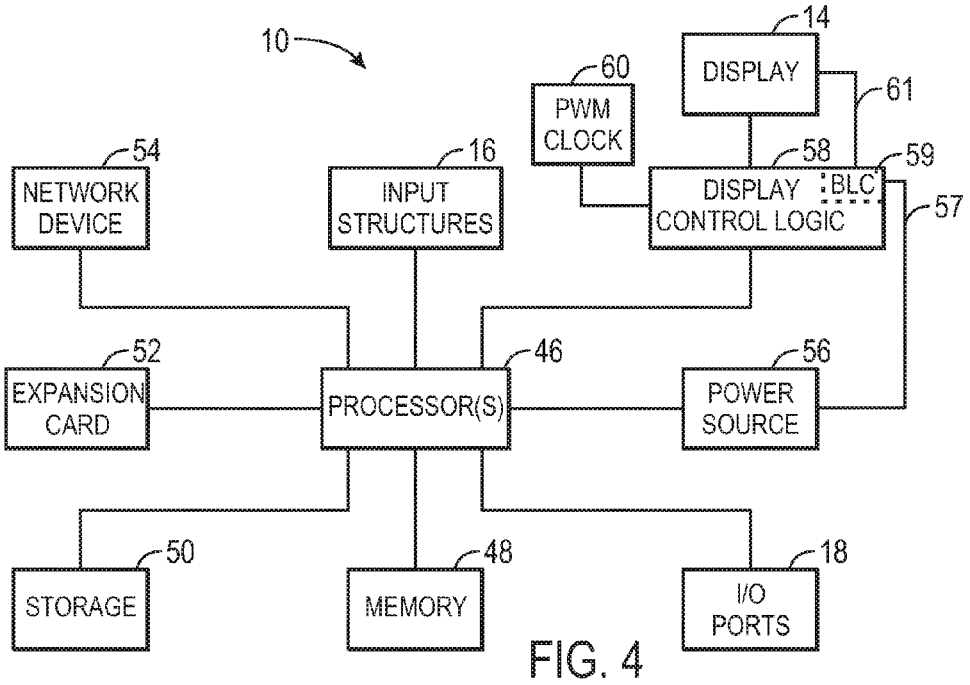
FIG. 4 is a simplified block diagram illustrating components of the electronic device of FIG. 1, in accordance with one embodiment of the present invention.

Internal components of electronic device 10 may be used to accomplish the toggling of the light source 30 in the LCD panel 22. FIG. 4 is a block diagram illustrating the components that may be used to perform the toggling procedure described above. Those of ordinary skill in the art will appreciate that the various functional blocks shown in FIG. 4 may include hardware elements (including circuitry), software elements (including computer code stored on a machine-readable medium) or a combination of both hardware and software elements. It should further be noted that FIG. 4 is merely one example of a particular implementation, other examples could include components used in Apple products such as an iPod®, MacBook®, MacBook® Pro, MacBook Air®, iMac®, Mac® mini, Mac Pro®, iPhone®, or additional electronic devices utilizing an LCD.

In the presently illustrated embodiment of the electronic device 10, the components may include the display 14, input structures 16, I/O ports 18, one or more processors 46, a memory device 48, non-volatile storage 50, expansion card(s) 52, a networking device 54, a power source 56, and a display control logic 58, and a pulse width modulator clock 60. With regard to each of these components, it is first noted that the display 14 may be used to display various images generated by the device 10 and may be provided in conjunction with a touch-sensitive element, such as a touch screen, that may be used as part of the control interface for the device 10.

The input structures 16 may include the various devices, circuitry, and pathways by which user input or feedback is provided to the processor(s) 46. Such input structures 16 may be configured to control a function of the electronic device 10, applications running on the device 10, and/or any interfaces or devices connected to or used by the device 10. For example, the input structures 16 may allow a user to navigate a displayed user interface or application interface. Non-limiting examples of the input structures 16 include buttons, sliders, switches, control pads, keys, knobs, scroll wheels, keyboards, mice, touchpads, and so forth. User interaction with the input structures 16, such as to interact with a user or application interface displayed on the display 12, may generate electrical signals indicative of user input. These input signals may be routed via suitable pathways, such as an input hub or bus, to the processor(s) 46 for further processing.

Additionally, in certain embodiments, one or more input structures 16 may be provided together with the display 14, such an in the case of a touch screen, in which a touch sensitive mechanism is provided in conjunction with the display 14. In such embodiments, the user may select or interact with displayed interface elements via the touch sensitive mechanism. In this way, the displayed interface may provide interactive functionality, allowing a user to navigate the displayed interface by touching the display 14.

As noted above, the I/O ports 18 may include ports configured to connect to a variety of external devices, such as a power source, headset or headphones, or other electronic devices (such as handheld devices and/or computers, printers, projectors, external displays, modems, docking stations, and so forth). The I/O ports 18 may support any interface type, such as a universal serial bus (USB) port, a video port, a serial connection port, an IEEE-1394 port, an Ethernet or modem port, and/or an AC/DC power connection port.

The processor(s) 46 may provide the processing capability to execute the operating system, programs, user and application interfaces, and any other functions of the electronic device 10. The processor(s) 46 may include one or more microprocessors, such as one or more "general-purpose" microprocessors, one or more special-purpose microprocessors and/or ASICS, or some combination of such processing components. For example, the processor(s) 46 may include one or more reduced instruction set (RISC) processors, as well as graphics processors, video processors, audio processors, and the like. As will be appreciated, the processor(s) 46 may be communicatively coupled to one or more data buses or chipsets for transferring data and instructions between various components of the electronic device 10.

Programs or instructions executed by the processor(s) 46 may be stored in any suitable manufacture that includes one or more tangible, computer-readable media at least collectively storing the executed instructions or routines, such as, but not limited to, the memory devices and storage devices described below. Also, these programs (e.g., an operating system) encoded on such a computer program product may also include instructions that may be executed by the processor(s) 46 to enable the device 10 to provide various functionalities, including those described herein.

The instructions or data to be processed by the processor(s) 46 may be stored in a computer-readable medium, such as memory 48. The memory 48 may include a volatile memory, such as random access memory (RAM), and/or a non-volatile memory, such as read-only memory (ROM). The memory 48 may store a variety of information and may be used for various purposes. For example, the memory 48 may store firmware for the electronic device 10 (such as basic input/output system (BIOS)), an operating system, and various other programs, applications, or routines that may be executed on the electronic device 10. In addition, the memory 48 may be used for buffering or caching during operation of the electronic device 10.

The components of device 10 may further include other forms of computer-readable media, such as non-volatile storage 50 for persistent storage of data and/or instructions. The non-volatile storage 50 may include, for example, flash memory, a hard drive, or any other optical, magnetic, and/or solid-state storage media. The non-volatile storage 50 may also be used to store firmware, data files, software programs, wireless connection information, and any other suitable data.

The embodiment illustrated in FIG. 4 may also include one or more card or expansion slots. The card slots may be configured to receive one or more expansion cards 52 that may be used to add functionality, such as additional memory, I/O functionality, or networking capability, to electronic device 10. Such expansion cards 52 may connect to device 10 through any type of suitable connector, and may be accessed internally or external to the housing of electronic device 10. For example, in one embodiment, the expansion cards 52 may include a flash memory card, such as a SecureDigital (SD) card, mini- or microSD, CompactFlash card, Multimedia card (MMC), or the like. Additionally, the expansion cards 52 may include one or more processor(s) 46 of the device 10, such as a video graphics card having a GPU for facilitating graphical rendering by device 10.

The components depicted in FIG. 4 also include a network device 54, such as a network controller or a network interface card (NIC), internal to the device 10. In one embodiment, the network device 54 may be a wireless NIC providing wireless connectivity over any 802.11 standard or any other suitable wireless networking standard. The network device 54 may allow electronic device 10 to communicate over a network, such as a personal area network (PAN), a local area network (LAN), a wide area network (WAN), or the Internet. Further, electronic device 10 may connect to and send or receive data with any device on the network, such as portable electronic devices, personal computers, printers, and so forth via the network device 54. Alternatively, in some embodiments, electronic device 10 may not include an internal network device 54. In such an embodiment, an NIC may be added as an expansion card 52 to provide similar networking capability as described above.

Further, the device 10 may also include a power source 56. In one embodiment, the power source 56 may be one or more batteries, such as a lithium-ion polymer battery or other type of suitable battery. The battery may be user-removable or may be secured within the housing of the electronic device 10, and may be rechargeable. Additionally, the power source 56 may include AC power, such as provided by an electrical outlet, and the electronic device 10 may be connected to the power source 56 via a power adapter. This power adapter may also be used to recharge one or more batteries of the device 10. Additionally, as illustrated in FIG. 4, the power source 56 may transmit power to the display 14 from path 57, through a backlight controller 59 of a display control logic 58 and across path 61. This backlight controller 59 may adjust the amount power provided to the display 14.

The display control logic 58 may be coupled to the display 14 and may be used to control light source 30 of the display 14. Alternatively, the display control logic may be internal to the display 14. In one embodiment, the display control logic 58 may act to toggle the light source 30 on and off. This toggling, for example, may be used to decrease the overall brightness of the display 14 when the power source 56, such as a battery, is being used. Additionally and/or alternatively, when the power source 56 is an AC power source, the overall brightness of the display 14 may be modified simply by raising and/or lowering the constant voltage level supplied to the light source 30.

In one embodiment, control of the brightness level of the display 14 may be adjusted through changing the duty cycle of an activation signal transmitted to the light source 30. For instance, if the duty cycle of the activation signal was 0%, then the light source 30 would remain off and the display 14 would be dark. Conversely, if the duty cycle of the activation signal was 100%, then the display 14 would be at full brightness because the light source 30 would always be active (however, as much power would be consumed as was used in the AC power source example above). In another example, if the duty cycle of the activation signal was at 50%, the display 14 would be at half the brightness of the display 14 being always on, however, the power consumption of the display 14 could be reduced by as much as 50% versus the light source 30 being continuously and fully powered.

Additionally, in an embodiment, control of the brightness level of the display 14 may be adjusted through changing the duty cycle of an activation signal transmitted to the light source 30 in conjunction with adjustment of the amount of current transmitted to the light source 30. This adjustment of the current transmitted to, for example, LEDs 34 of the light source 30, may occur when the duty cycle of an activation signal (such as a pulse width modulation signal) is to be set below a threshold level. For instance, if desired brightness of the display 14 would call for the duty cycle of the activation signal to be less than, for example, 20%, then the duty cycle may be set to 20% and the current to be transmitted to active LEDs 34 of the light source 30 may be reduced. In this manner, the brightness of the display may be adjusted through independent or combined control of both the duty cycle of an activation signal and current transmitted to the light source 30.

In one embodiment, a pulse width modulator clock 60 may provide the activation signal to the light source 30 as a pulse width modulated (PWM) signal. Additionally, it should be noted that multiple PWM signals may be generated by the pulse width modulator clock 60. For example, a PWM signal may be generated for each string of LEDs 34 present in the light source 30. Furthermore, the duty cycle of the PWM signal generated by the pulse width modulator clock 60 may be adjusted, for example, by the display control logic 58, in response to user initiated changes to the display 14 brightness via, for example, inputs 16. In another embodiment, as described above, the display control logic 58 may be used to automatically adjust the brightness of the display 14 by varying the duty cycle of the PWM signal when the power source 56 is a battery. For example, the duty cycle of the PWM signal may be adjusted based on the amount of internal power remaining in the battery. In another embodiment, ambient light around the electronic device 10 may be detected and the duty cycle of the PWM signal may be adjusted based on the level of ambient light detected.

In one embodiment, the display control logic 58 may be coupled to and external from the pulse-width modulator clock 60. Alternatively, in one embodiment, the pulse width modulator clock 60 may be internal to the display control logic 58. Regardless of the location of the pulse width modulator clock 60, the PWM signal generated by the pulse width modulator clock 60 may be an oscillating signal used to toggle the light source 30 on and off. Moreover, the duty cycle of the PWM signal may be selectable and may vary, for example, anywhere from 0-100%. As described previously, the duty cycle of the PWM signal may determine the overall brightness of the display 14. In this manner, the PWM signal may also reduce the overall power consumption of the display 14 by controlling the amount of time that the LEDs 34 of the light source 30 are "on" during any period of time.

The PWM signal may provide high brightness resolution (i.e., at least 10-bit resolution) in the device 10. That is, the PWM signal may allow for 1024 different brightness levels to be achieved by the light source 30. However, it may be desirable to allow for even greater brightness resolution (i.e., at least 13-bit resolution) in the device 10 (which would allow for 8192 different brightness levels to be achieved by the light source 30). Generation of this 13-bit brightness resolution may be accomplished through, for example, temporal dithering of the PWM signal as will be discussed in greater detail below.

Figure 5:
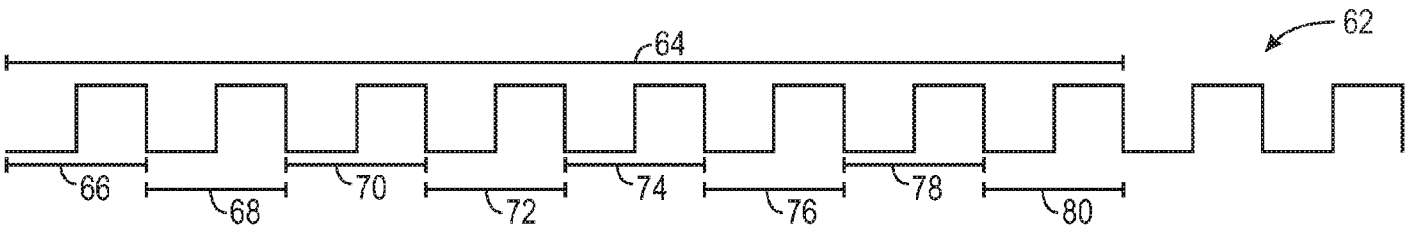
FIG. 5 is a first timing sequence illustrating a 10-bit resolution pulse waveform, in accordance with one embodiment of the present invention.

FIG. 5 illustrates a pulse waveform 62 may represent the PWM signal received by the display 14 from the pulse width modulator clock 60 via display control logic 58. In one embodiment, the pulse waveform 62 may have a frequency of 24 kHz and a duty cycle of 50%. Moreover, the pulse waveform 62 may be divided into segments that include, for example, groups of eight pulses. One such segment is illustrated in FIG. 5 as a frame 64. This frame 64 includes eight pulses, 66-80 that may each be independently altered to allow for an extra 3-bits of resolution more than the pulse waveform 62 would otherwise be capable of attaining. However, the frame 64 could alternatively include 2 pulses to allow for an extra 1-bit of resolution, 4 pulses to allow for allow for an extra 2-bits of resolution, or other values of pulses in a frame 64 so as to correspond to any additional resolution. The attainment of the extra bits of resolution will be described below with respect to a 3-bit increase, however, as noted above, other levels of resolution gain may be attained through adjustment of the number of pulses in frame 64.

In one embodiment, the pulse waveform 62 may be generated from a 10-bit resolution pulse width modulator clock 60. That is, each pulse, e.g., 66, may have 1024 levels corresponding to the amount of time the pulse, e.g., pulse 66, is high. For example, at a 50% duty cycle, each of pulses 66-80 may be at a level 512 (i.e., half of the 1024 total levels). The next resolution available for each of pulses 66-80 would be level 513, which would correspond to a duty cycle of 50.097%. Thus, utilizing a 10-bit resolution pulse width modulator clock 60, a user is able to adjust the brightness of a display 14 across $2^{10}$ (1024) brightness levels. However, through modification of the pulse waveform 62, brightness levels for a display 14 selectable by a user may expand to $2^{13}$ (8192) brightness levels.

Figure 6:
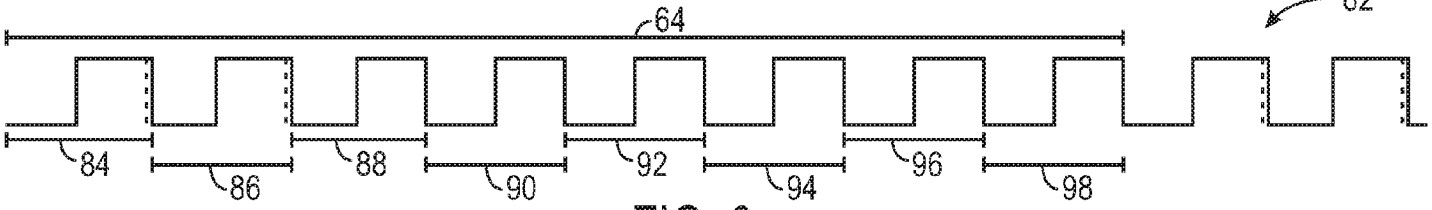
FIG. 6 is a second timing sequence illustrating a 13-bit resolution pulse waveform, in accordance with one embodiment of the present invention.

FIG. 6 illustrates a second pulse waveform 82 that may represent a modified PWM signal received by the display 14 from the display control logic 58. The pulse waveform 62 may be divided into segments that include groups of eight pulses, whereby frame 64 illustrates one such segment. Moreover, frame 64 may include eight pulses, 84-98. As with pulse waveform 62, pulse waveform 82 may be generated from a 10-bit resolution pulse width modulator clock 60 such that each of the pulses 84-98 may be at one of 1024 levels corresponding to the amount of time the pulse, e.g., pulse 66, is high. However, to allow for greater resolution (e.g., $2^{13}$ or 8192 levels at which a pulse, e.g., pulse 84, is high), the pulses 84-98 may have differing duty cycles. For example, pulses 84 and 86 may be at a level 513 of 1024 levels (corresponding to a duty cycle of 50.097%) while the remaining pulses 88-98 may be at a level 512 of the 1024 total levels (corresponding to a duty cycle of 50%).

Accordingly, during frame 64, pulse waveform 82 includes six pulses (pulses 88-98) at a level of 512 of 1024 levels (corresponding to a 50% duty cycle) and two pulses (pulses 84 and 86) at a level of 513 of 1024 levels (corresponding to a duty cycle of 50.097%). As such, taken over the entirety of frame 64, the pulse waveform 82 has an average level of 512.25 of 1024 levels (corresponding to a duty cycle of 50.024%). Notably, this resolution corresponds to the same duty cycle as if a user selected a level of 4098 of 8192 levels for each pulse of a frame driven by a 13-bit resolution pulse width modulator. That is, each pulse, e.g., pulse 84, of the frame 64 driven by the 10-bit resolution pulse width modulator clock 60 to a single level greater than the remaining pulses, e.g., pulses 86-98, of frame 64 allows for an average level that corresponds to a specified single level of each pulse in a frame driven by a 13-bit resolution pulse width modulator.

For example, pulse waveform 82 and all pulses 84-98 in frame 64 driven at level 512 of 1024 levels would have an average level of 512 (corresponding to a duty cycle of 50%) for the frame 64; identical to a frame driven to level 4096 of 8192 levels of a 13-bit resolution pulse width modulator. If, however, pulse waveform 82 includes pulse 84 driven in frame 64 at level 513 of 1024 levels and remaining pulses 86-98 driven at level 512 of 1024 levels, frame 64 would have an average level of 512.125 (corresponding to a duty cycle of 50.012% and identical to a frame driven to level 4097 of 8192 levels of a 13-bit resolution pulse width modulator). Similarly, if pulse waveform 82 includes pulses 84 and 86 in frame 64 driven to a level 513 of 1024 levels and remaining pulses 88-98 were driven to a level 512 of 1024 levels, frame 64 would have an average level of 512.25 (corresponding to a duty cycle of 50.024% identical to a frame driven to level 4098 of 8192 levels of a 13-bit resolution pulse width modulator). Thus, through temporally dithering the pulse waveform 82 (i.e., adjusting the pulse width of selected pulses in a pulse waveform, such as pulse waveform 82) 13-bits of resolution across a frame 64 may be generated from a 10-bit pulse width modulator clock 60.

Thus, as illustrated in FIG. 6, the temporal dithering of a pulse waveform such as pulse waveform 82 may change the duty cycle of pulses 84 and 86 relative to pulses 88-98. However, adjustment of two adjacent pulses, e.g., 84 and 86, during each frame 64 may cause a visible artifact to be generated on the display 14, which may be noticeable by a user. Accordingly, the location of adjusted pulses in a frame of a pulse waveform may be modified to minimize visual artifacts.

Figure 7:
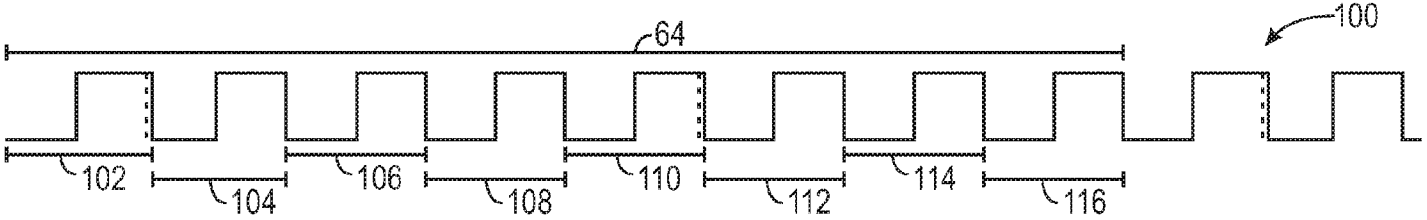
FIG. 7 is a third timing sequence illustrating another 13-bit resolution pulse waveform, in accordance with one embodiment of the present invention.

FIG. 7 illustrates a third pulse waveform 100 that may represent a modified PWM signal received by the display 14 from the display control logic 58. The pulse waveform 100 may include frame 64 that may include eight pulses, 102-116. As with pulse waveforms 62 and 82, pulse waveform 100 may be generated from a 10-bit resolution pulse width modulator clock 60 such that each of the pulses 102-116 may be driven at one of 1024 levels corresponding to the amount of time the pulse, e.g., pulse 102, is high. However, to allow for greater resolution (e.g., $2^{13}$ or 8192 levels at which a pulse, e.g., pulse 102, is high), the pulses 102-116 may have differing duty cycles. In pulse waveform 100, pulses 102 and 110 may be driven at a level 513 of 1024 levels (corresponding to a duty cycle of 50.097%) while the remaining pulses 104-108 and 112-116 may be driven at a level 512 of the 1024 total levels (corresponding to a duty cycle of 50%).

Accordingly, during frame 64, pulse waveform 100 includes six pulses (pulses 104-108 and 112-116) driven at a level of 512 of 1024 levels (corresponding to a 50% duty cycle) and two pulses (pulses 102 and 110) driven at a level of 513 of 1024 levels (corresponding to a duty cycle of 50.097%). As such, taken over the entirety of frame 64, the pulse waveform 100 has an average level of 512.25 of 1024 levels (corresponding to a duty cycle of 50.024%), that is, the same duty cycle as if a user selected a level of 4098 of 8192 levels to drive a frame via a 13-bit resolution pulse width modulator. That is, each pulse, e.g., pulse 102, of the frame 64 activated at a single level greater than the remaining pulses, e.g., pulses 104-116, of frame 64 allows for an average level that corresponds to a single level driven by a 13-bit resolution pulse width modulator. Moreover, as pulses 102 and 110 are temporally non-adjacent in frame 64, the temporally greater energy pulses (e.g., pulse 102 and 110) are evenly distributed through the frame 64. Thus, by separating pulses 102 and 110 through the frame 64, any visual impact generated on the display 14 from the inclusion of pulses of differing levels (e.g., pulse 102 and 110) may be lessened, thus reducing potential visual artifacts on display 14.

As discussed above, the display control logic 58 may operate to transmit a PWM signal from the pulse width modulator clock 60 to the display 14. FIG. 8 illustrates a flow chart 118 of the steps that the display control logic 58 may undertake to adjust the PWM signal to a specific level. As illustrated in flow chart 118, the display control logic 58 may receive a brightness request in step 120. This brightness request may, for example, include a signal corresponding to a desired brightness level selected by a user for the display 14. Alternatively, the brightness request may, for example, include a signal corresponding to a desired brightness level for the display 14, as determined by the processor 46 of the device. For example, the processor 46 may receive a signal corresponding to an ambient light level. Additionally or alternatively, the processor 46 may monitor the power source 56 to determine remaining power of the power source. If the remaining power available in the power source 56 falls below a threshold, the processor 46 may transmit a brightness request to the display control logic to reduce the brightness of the display 14 (e.g., through adjustment of the duty cycle of the PWM signal transmitted to the display 14).

Additionally in step 120, the display control logic 58 may also receive a PWM signal from the pulse width modulator clock 60 in step 120. As previously noted, the pulse width modulator clock 60 may have 10-bit resolution such that the PWM signal may include 1024 levels (i.e., steps) that may be utilized to alter the brightness of the display 14.

In step 122, the display control logic 58 may determine and generate a pulse waveform, e.g. pulse waveform 100, from multiple PWM pulses to be transmitted to the display 14. This pulse waveform, e.g. pulse waveform 100, may be generated as a modified version of the received PWM signal. That is, the display control logic 58 may determine if any adjustments are to be made to the received PWM signal based on the received brightness request. For example, the display control logic 58 may determine that a brightness request may correspond to a pulse waveform with a duty cycle of 50.024%. As disclosed above, taken over an entire frame 64, a pulse waveform (e.g., pulse waveform 100) may have an average level of 512.25 of 1024 levels (which corresponds to a duty cycle of 50.024%). That is, the display control logic 58 may adjust the on time of various pulses (such as pulse 102 and 110) relative to other pulses (such as pulses 104-108 and 112-116) in a frame 64 to generate a pulse waveform (e.g., pulse waveform 100) such that the over the entire frame 64, an average duty cycle of 50.024% is generated (just as if a user had selected a level of 4098 of 8192 levels from a 13-bit resolution pulse width modulator).

Generation of this pulse waveform may be accomplished utilizing, for example, a look-up table. The look-up-table may include memory or other storage that stores a pre-computed sequence for each brightness setting, which the display control logic 58 may access. Alternatively, an algorithmic generator, for example, a binary programmable counter, which computes the pulse waveform in real-time or near real-time based on the desired brightness setting may be utilized. An additional algorithmic generator that may be utilized to compute the pulse waveform in real-time or near real-time based on the desired brightness setting may be utilized will be described in greater detail with respect to FIG. 9.

Subsequent to the generation of the pulse waveform (e.g., pulse waveform 100) in step 122, the display control logic 58 may transmit the generated pulse waveform to the display 14 in step 124. In one embodiment, this transmission may be continuously transmitted to the display. That is, there is not a break between transmission of multiples pulse waveforms to the display. In this manner, the display control logic 58 may be able to temporally dither a PWM signal to allow for a greater number of brightness levels to be displayed on the display 14. Furthermore, it should be noted that in other embodiments, the brightness request and PWM signal may be delivered directly to the display 14 for determination, generation, and application of a generated pulse waveform (e.g., pulse waveform 100). That is, in some embodiments, circuitry, for example, processing circuitry, may be utilized in the display to perform steps 122 and 124 of FIG. 8. In another embodiment, the display control logic 58 may be physically located in the display 14. Regardless of the location of the circuitry for performing the steps illustrated in FIG. 8, through the use temporal dithering of a PWM signal, a large dimming range for the display 14 as well as removal of visual artifacts on the display 14 may be concurrently accomplished.

FIG. 9 illustrates an example of an algorithmic generator that may be utilized to compute a pulse waveform in real-time or near real-time based on the desired brightness setting. The algorithmic generator may be, for example, a delta-sigma bitstream generator 126 that may be utilized to compute the determined pulse waveform. The delta-sigma bitstream generator 126 may receive input values 128 that correspond to a desired output pulse waveform value. The delta-sigma bitstream generator 126 may utilize, for example, the three least most significant bits as inputs to an adder circuit, such as 5-bit adder 130. The output of the 5-bit adder 130 may be passed to a latch circuit, such as 5-bit latch 132, which may include a reset and a clock input. The clock input may, for example, determine the rate at which the output of the delta-sigma bitstream generator 126 is generated. The output of the 5-bit latch 132 may be passed as an input to the 5-bit adder 130, and the most significant bit of the 5-bit latch may also be passed to an inverter 134, which has an output connected to both an AND gate 138 and to the input to the 5-bit adder 130. Additionally, an input to the AND gate 138 may an output of an OR gate 136 that receives the least significant bits from the input values 128. In operation, the delta-sigma bitstream generator 126 may receive an input value represented in table 140 of FIG. 10 as desired pulse waveform to be generated. The binary values corresponding to the selected input value are then passed through the delta-sigma bitstream generator 126 and outputted based on the cycling of the clock signal passed into the 5-bit latch 132. This output may then generate the desired pulse waveform.

Figure 11:
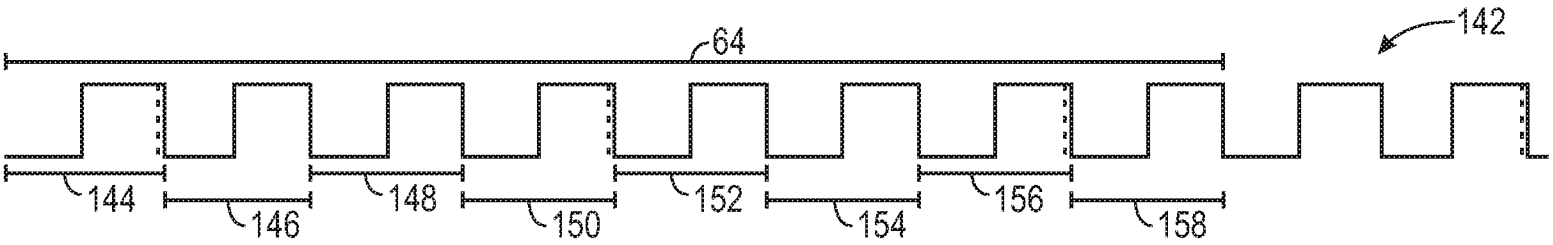
FIG. 11 is a fourth timing sequence illustrating another 13-bit resolution pulse waveform, in accordance with one embodiment of the present invention.

FIG. 11 illustrates an example of a 142 that may represent a modified PWM signal received by the display 14 and generated from the delta-sigma bitstream generator 126 in the display control logic 58. The pulse waveform 142 may correspond to the fourth value in table 140 of FIG. 10 and may include frame 64 having eight pulses, 144-158. As with pulse waveforms 62, 82, and 100, pulse waveform 142 may be generated from a 10-bit resolution pulse width modulator clock 60 such that each of the pulses 144-158 may be driven at one of 1024 levels corresponding to the amount of time the pulse, e.g., pulse 144, is high. However, to allow for greater resolution (e.g., $2^{13}$ or 8192 levels at which a pulse, e.g., pulse 144, is high), the pulses 102-116 may have differing duty cycles. In pulse waveform 100, pulses 144, 150, and 156 may be driven at a level 513 of 1024 levels (corresponding to a duty cycle of 50.097%) while the remaining pulses 146, 148, 152, 154, and 158 may be driven at a level 512 of the 1024 total levels (corresponding to a duty cycle of 50%).

Accordingly, during frame 64, pulse waveform 100 includes five pulses (pulses 146, 148, 152, 154, and 158) driven at a level of 512 of 1024 levels (corresponding to a 50% duty cycle) and three pulses (pulses 144, 150, and 156) driven at a level of 513 of 1024 levels (corresponding to a duty cycle of 50.097%). As such, taken over the entirety of frame 64, the pulse waveform 100 has an average level of 512.375 of 1024 levels (corresponding to a duty cycle of 50.036%), that is, the same duty cycle as if a user selected a level of 4099 of 8192 levels to drive a frame via a 13-bit resolution pulse width modulator. That is, each pulse, e.g., pulse 144, of the frame 64 activated at a single level greater than the remaining pulses, e.g., pulses 146, 148, 152, 154, and 158, of frame 64 allows for an average level that corresponds to a single level driven by a 13-bit resolution pulse width modulator. Moreover, as pulses 144, 150, and 156 are temporally non-adjacent in frame 64, the temporally greater energy pulses (e.g., pulse 144, 150, and 156) are evenly distributed through the frame 64. Thus, by separating pulses 144, 150, and 156 through the frame 64, any visual impact generated on the display 14 from the inclusion of pulses of differing levels (e.g., pulse 144, 150, and 156) may be lessened, thus reducing potential visual artifacts on display 14.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device, comprising:

a display having a plurality of light emitting diodes (LEDs) adapted to generate light to illuminate a plurality of pixels in the display;

a pulse width modulator adapted to generate a first pulse width modulated (PWM) signal at a first frequency; and display control logic adapted to:

modify at least one pulse of a series of pulses of the first PWM signal to generate a pulse waveform;

increase an amount of time the at least one pulse is in an on state relative to an amount of time that other pulses of the series of pulses are in the on state;

increase an amount of time that a second pulse of the series of pulses is in the on state relative to the amount of time that the other pulses of the series of pulses are in the on state;

select a position of the first at least one pulse and the second at least one pulse in the series of pulses such that the first at least one pulse and the second at least one pulse are non-adjacent pulses in the series of pulses to minimize a possible occurrence of a visual artifact on the display; and transmit the pulse waveform to the display.

2. The electronic device of claim 1, wherein the pulse width modulator comprises a 10-bit resolution pulse width modulator.

3. The electronic device of claim 2, wherein the display control logic is adapted to generate the pulse waveform based on a display brightness signal.

4. The electronic device of claim 3, wherein the display brightness signal is generated based on user input.

5. The electronic device of claim 3, wherein the display brightness signal is generated based on a threshold value of a power source of the electronic device.

6. The electronic device of claim 1, wherein the display control logic is adapted to increase an amount of time that a third pulse of the series of pulses is in the on state relative to the amount of time that the other pulses of the series of pulses are in the on state.

7. The electronic device of claim 6, wherein the display control logic is adapted to select the first at least one pulse, the second at least one pulse, and the third pulse such that the first at least one pulse, the second at least one pulse, and the third pulse are non-adjacent pulses in the series of pulses.

8. An electronic device, comprising:

a pulse width modulator adapted to generate a pulse width modulated (PWM) signal for control of a number of levels of brightness of a display; and a display control logic adapted to:

receive the PWM signal and to temporally dither the PWM signal by adjusting a duty cycle of at least one pulse of the PWM signal relative to a duty cycle of a series of remaining pulses of the PWM signal during a given period of time for controlling the activation and deactivation of at least one light emitting diode (LED);

adjust a duty cycle of a second at least one pulse of the PWM signal to match the duty cycle of the at least one pulse of the PWM signal; and distribute the second at least one pulse of the PWM signal as a non-adjacent pulse with respect to the at least one pulse of the PWM signal during the given period of time to minimize a possible occurrence of a visual artifact on the electronic device.

9. The electronic device of claim 8, wherein the display control logic is adapted to adjust a total number of pulses during the given period of time to alter the number of levels of brightness of a display.

10. The electronic device of claim 8, wherein the given period of time comprises a frame comprising eight pulses.

11. An electronic device, comprising:

a display having a plurality of light emitting diodes (LEDs) to generate light to illuminate a plurality of pixels in the display;

a pulse width modulator adapted to generate a pulse width modulated (PWM) signal; and display control logic adapted to;

adjust a duty cycle of a first pulse of the PWM signal relative to a duty cycle of a group of pulses of the PWM signal based on a desired brightness of the display;

adjust a duty cycle of a second pulse of the PWM signal to match the duty cycle of the first pulse of the PWM signal relative to a level of resolution of the group of pulses; and select a position of the second pulse of the PWM signal in the group of pulses such that the second pulse is non-adjacent to the first pulse in the group of pulses to minimize a possible occurrence of a visual artifact on the display.

12. The electronic device of claim 11, wherein the first pulse, the second pulse, and the group of pulses comprise a frame of eight pulses over a given period of time.

13. The electronic device of claim 12, wherein the display control logic is adapted to adjust the duty cycle of the first pulse of the PWM signal to generate a brightness resolution greater than the brightness resolution available from the group of pulses.

14. The electronic device of claim 11, wherein the display control logic is adapted to adjust a duty cycle of a third pulse of the PWM signal to match the duty cycle of the first pulse and the second pulse of the PWM signal relative to a level of resolution of the group of pulses.

15. The electronic device of claim 14, wherein the display control logic is adapted to select the third pulse of the PWM signal such that the third pulse is non-adjacent to the first pulse and the second pulse in the group of pulses.

* * * * *